United States Patent [19]

Waldron

[11] 3,996,775

[45] Dec. 14, 1976

[54] ANCHORING DEVICE FOR SECURING BICYCLES

[76] Inventor: William K. Waldron, 17801 Snow, Dearborn, Mich. 48124

[22] Filed: Sept. 26, 1975

[21] Appl. No.: 616,942

[52] U.S. Cl. ..... 70/234; 211/5

[51] Int. Cl.[2] ..... E05B 73/00

[58] Field of Search ..... 70/234, 233, 235; 211/5, 19, 18, 20, 21, 17; 248/203

[56] References Cited

UNITED STATES PATENTS

| | | | |
|---|---|---|---|
| 653,386 | 7/1900 | Hunter | 211/19 |
| 3,865,246 | 2/1975 | Lieb et al. | 70/234 X |
| 3,918,279 | 11/1975 | Williamson | 70/234 |

FOREIGN PATENTS OR APPLICATIONS

| | | | |
|---|---|---|---|
| 8,249 | 1898 | United Kingdom | 70/234 |
| 18,896 | 1897 | United Kingdom | 211/18 |

*Primary Examiner*—J. Franklin Foss
*Attorney, Agent, or Firm*—Adolph G. Martin

[57] ABSTRACT

An anchoring device for securing bicycles, motorcycles, snowmobiles, power mowers and other similar items stored in home garages. The anchoring device has an elongated bolt which can be permanently installed in a wall of the garage. A non-rotatable head is slidably mounted on the free end of the elongated bolt. A 'U' bolt is threadably connected on one end to the head, and provided on the other end with an eye. A hasp threadably engaged on the elongated bolt receives therethrough the eye on the 'U' bolt to which a padlock is attachable for securing a chain or cable passing through and around the items to be protected in the customary manner.

2 Claims, 5 Drawing Figures

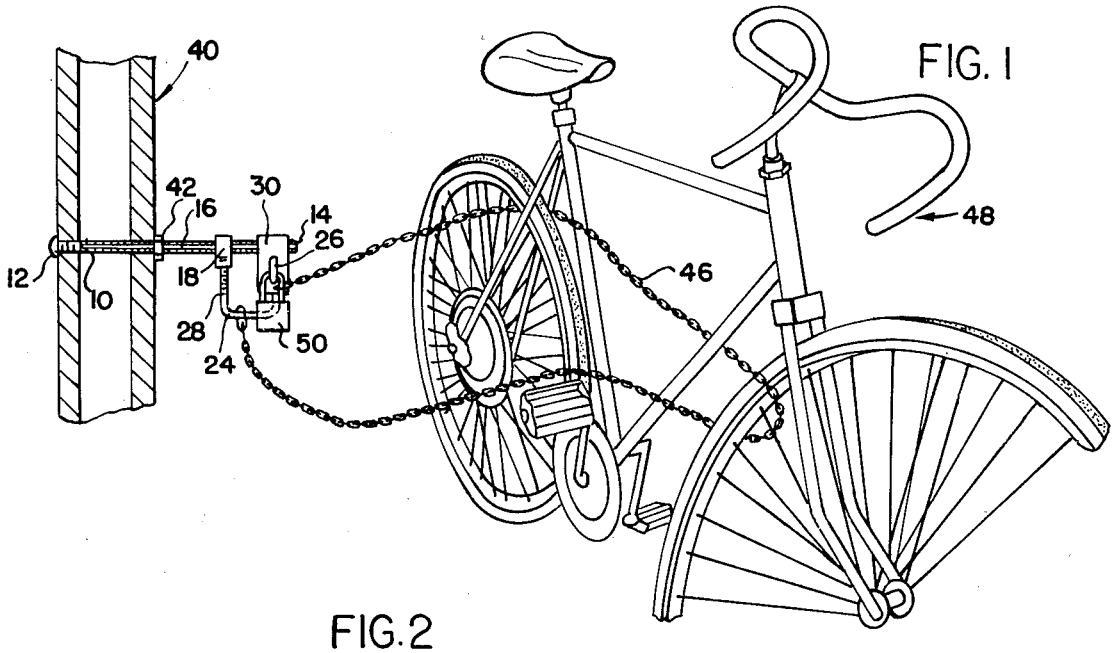
FIG. 1
FIG. 2
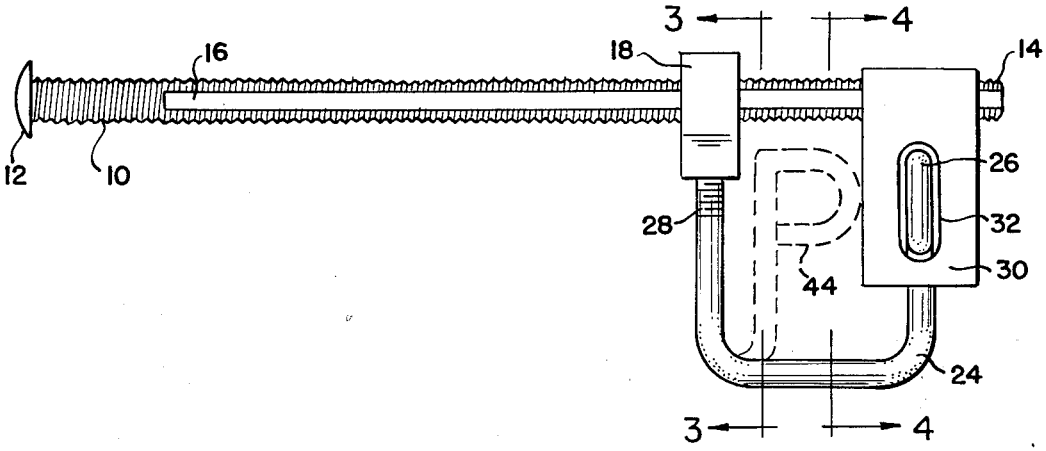
FIG. 3
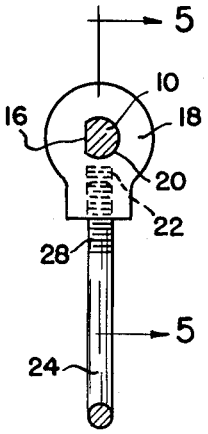
FIG. 4
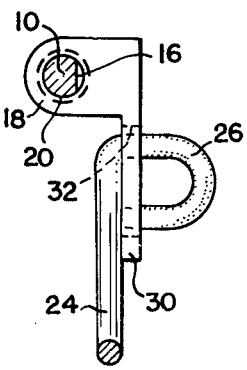
FIG. 5
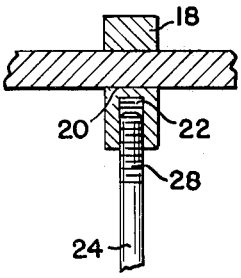

ANCHORING DEVICE FOR SECURING BICYCLES

BACKGROUND OF THE INVENTION

This invention relates generally to anti-theft devices for protecting bicycles and similar items in home garages which are customarily devoid of suitable fixed supports to which such items can be locked. More particularly it pertains to a device which can be permanently installed in the wall of a home garage to provide an anchoring station to which a chain or cable securing the item or items to be protected can be attached by means of a padlock.

Most such devices presently in use are lightweight and are seldom attached to an object which is permanently installed in the garage wall. Consequently, bicycles and other such items can be readily stolen from home garages by amateur thieves with the use of only standard hand tools such as hacksaws, bolt clippers, chisels and hammers. Fully cognizant of this situation, the applicant has developed an inexpensive and sturdy anchoring device which is easy to install, and comprises components that cannot be readily breached even by professional thieves using special tools and equipment.

SUMMARY OF THE INVENTION

This invention consists of an elongated bolt 10 having on the outer end thereof a longitudinally disposed flat section 16. A head 18, slidably mounted on the outer end of the elongated bolt 10, has therein a threaded opening 22. A 'U' bolt 24 is engaged on one end in the threaded opening 22 of the head 18, and provided on the other end with an eye 26. A hasp 30, threadably engaged on the outer end of the elongated bolt 10, has therein a vertically disposed slot 32 for reception of the eye 26 on the 'U' bolt 24.

DESCRIPTION OF THE DRAWING

FIG. 1 is a side elevation view showing the applicant's anchoring device, installed in a garage wall 40, to illustrate the manner in which it is used to secure a bicycle 48.

FIG. 2 is an enlarged view of the applicant's anchoring device, showing structural details of the invention.

FIG. 3 is a section view, taken substantially on plane 3—3 in FIG. 2, showing the flat section 16 on the elongated bolt 10.

FIG. 4 is a section view, taken substantially on plane 4—4 in FIG. 2, showing the characteristic shape of the hasp 30 and the eye 26 on the 'U' bolt 24.

FIG. 5 is a section view, taken substantially on plane 5—5 in FIG. 3, showing the threaded opening 22 in the head 18.

CONSTRUCTION

For a more detailed description of the invention, reference is made to the drawing in which numeral 10 designates an elongated bolt having a head 12 and a threaded portion 14. A longitudinally disposed flat section 16 is provided on the threaded portion 14 of the elongated bolt 10. A head 18, with a transverse opening 20 therethrough, having a cross section matching that of the elongated bolt 10, is slidably engaged on the threaded portion 14 of the bolt 10. A downwardly disposed threaded opening 22 is provided in the head 18.

A 'U' bolt 24, with an eye 26 on one end thereof, has threads 28 on the other end engaged in the threaded opening 22 of the head 18. A hasp 30, engaged on the threaded portion 14 of the elongated bolt 10, has therein a slot 32 for receiving therethrough the eye on the 'U' bolt 24. In practice, it is desirable that the various components of the applicant's anchoring device be made of heavy gauge materials, and preferably hardened so as to be invulnerable to ordinary cutting devices such as hacksaws, bolt cutters and chisels.

The preceding discussion completes a description of the structure characterizing the single embodiment of the applicant's invention herein disclosed; however, to facilitate a more thorough and comprehensive understanding of the subject matter, a discussion of the manner in which the device is used to fulfill its intended function is immediately hereinafter set forth.

USE AND OPERATION

In practice, the applicant's anchoring device is mounted on a wall 40 of the garage or shed in which the bicycle or other items to be protected are stored. This is done by passing the elongated bolt 10 through the wall 40, with the flat section 16 thereon in a vertically disposed position, and securing it with a nut 42 as illustrated in FIG. 1.

The hasp 30 is then placed in a dependent position, as shown, and the head 18 slidably adjusted on the elongated bolt 10 so that the 'U' bolt 24 can be pivoted from the broken line position 44 to the full line position shown in FIGS. 2 and 4. In this position, the eye 26 on the 'U' bolt 24 holdably engages the slot 32 in the hasp 30.

A cable or chain 46, securing the bicycle 48 or other items to be protected, is then attached to the 'U' bolt 24 by a padlock 50 in the customary manner as shown in FIG. 1. In practice, it is recommended that only heavy duty padlocks 48, cables or chains 46 be used, so as to defeat the efforts of thieves equipped only with ordinary cutting tools and devices.

Based upon the foregoing discussion, the applicant is of the opinion that his invention has fulfilled a long-felt need in the field of anti-theft devices for protecting bicycles and other similar items stored in home garages, and that he has accordingly made a valuable contribution to the related art. The invention, however, was described with reference to the structural details of only a single embodiment, but it will be appreciated by those familiar with the art that the principles involved are susceptible of numerous other practical adaptations.

I therefore claim as new, and desire to secure by Letters Patent:

1. An anchoring device for use in conjuction with a chain and padlock to protect bicycles, such device comprising a head having therethrough a non-circular opening, an elongated bolt for attachment to a fixed support, such elongated bolt being slidably engaged in the non-circular opening and having a cross section matching that of such non-circular opening so as to render the head non-rotatable, a 'U' bolt threadably connected on one end to the head, an eye on the other end of the 'U' bolt, and a hasp threadably engaged on the elongated bolt for receiving therethrough the eye on the 'U' bolt.

2. An anchoring device of claim 1 in which the elongated bolt has thereon a longitudinally disposed flat section.

* * * * *